US010292508B1

(12) United States Patent
Kim

(10) Patent No.: US 10,292,508 B1
(45) Date of Patent: May 21, 2019

(54) MULTI-FUNCTION NECK PILLOW

(71) Applicant: Chang Eun Kim, Lake Forest, CA (US)

(72) Inventor: Chang Eun Kim, Lake Forest, CA (US)

( * ) Notice: Subject to any disclaimer, the term of this patent is extended or adjusted under 35 U.S.C. 154(b) by 0 days.

(21) Appl. No.: 16/240,421

(22) Filed: Jan. 4, 2019

(51) Int. Cl.
*A47G 9/10* (2006.01)
*A47G 9/02* (2006.01)

(52) U.S. Cl.
CPC ..... *A47G 9/1045* (2013.01); *A47G 9/0223* (2013.01); *A47G 9/1081* (2013.01)

(58) Field of Classification Search
CPC .. A47G 9/1027; A47G 9/1045; A47G 9/1081; A47C 7/383
See application file for complete search history.

(56) References Cited

U.S. PATENT DOCUMENTS 3,863,283 A * 2/1975 Mohr ..... A47G 9/1045 5/490
3,879,775 A * 4/1975 Iwata ..... A47G 9/1045 190/1
6,951,035 B2 * 10/2005 Kinchen ..... A47C 16/04 5/420
8,127,382 B1 * 3/2012 Plascencia ..... A47G 9/1045 5/490
8,418,293 B2 4/2013 Tansingco
9,622,901 B2 4/2017 Schwingendorf et al.
9,801,480 B1 10/2017 McCain
1,005,190 A1 8/2018 Peyser
2008/0172792 A1 * 7/2008 Dreessen ..... A47G 9/1045 5/636
2016/0228779 A1 * 8/2016 Honaker ..... A63H 3/003
2017/0099967 A1 * 4/2017 Holbrook ..... A47G 9/10
2017/0202376 A1 * 7/2017 Isis ..... A47G 21/185
2017/0208972 A1 * 7/2017 Williams ..... A61F 5/055
2018/0042408 A1 * 2/2018 Huang ..... A47G 9/1027
2018/0063612 A1 * 3/2018 Fuchs ..... H04R 5/023
2018/0064269 A1 * 3/2018 Carlile ..... A47G 9/1045
2018/0263389 A1 * 9/2018 Lee ..... A47G 9/1045

* cited by examiner

*Primary Examiner* — Eric J Kurilla
(74) *Attorney, Agent, or Firm* — IPLA P.A.; James E. Bame

(57) ABSTRACT

A multi-function pillow comprises: a first and second layer forming an elongate envelope; an inflatable tube detachably attached to and along a first lining of the elongate envelope, where an air cap to the tube is formed through the elongate envelope; a tube retainer formed in the elongate envelope to retain the tube within the envelope; a blanket detachably attached to and along a second lining of the envelope, where the blanket is either stored and zipped in the envelope or taken out for use by unzipping the envelope; and a twine to flex the pillow into a neck cushion, wherein the twine is formed to run in and along the elongate envelope with each end of the twine extending from each end portion of the elongate envelope adjacent to the tip lines.

20 Claims, 5 Drawing Sheets

MULTI-FUNCTION NECK PILLOW

BACKGROUND

This invention relates to a neck cushion pillow, more particularly to an improved multi-function pillow having a blanket detachably attached thereto, which could serve as a hand-carry fashion pillow with a number of different useful functions.

Travel pillows have been getting highly demanded on the market recent years as most airlines allow you to bring onto the plane carry-on items. Out of a variety of different personal items, a personal pillow is listed on top of most others since it gives you comfort that continues throughout your travel. In particular, if you travel a long distance by airplane, the comfort you save with the help of comfortable pillow supporting your neck will be nothing to none when it comes to sleeping in airplane chair.

Assuming that tiresome traveling is an uncomfortable activity, the advent of travel pillows would be inevitable, which can alleviate physical discomfort. Being different from regular pillows designed for small, unusual spaces, travel pillows are meant to be easy to travel with. Travel pillows come in a variety of shapes and sizes, and can be used to support a lot of sleep variations. The market demand has easily called on a U-shaped pillow to simply keep your head upright. This may help you sleep in case of turbulence in flight and prevent you from developing or intensifying neck pain. Also, if you tend to sit upright, but roll your head from side to side as you sleep in a chair, or if you frequently battle neck pain, a U-shaped neck cushion pillow could be an option.

Neck pillows on the market are known to provide neck support and hold a healthy posture with stability of positioning of your neck. However, a U-shape neck pillow dominant on the market leads to unwelcome inconveniences in terms of hand-carry with its awkward shape and its limitation that only allows you to expect a neck pillow and nothing more.

A demand on the market is an introduction of a neck pillow that provides other functions in addition to comforting your neck.

Another market demand on a travelling neck pillow is an appeal to fashion when carrying a neck pillow so that a person who is hand-carrying a neck pillow would let others do not know if it is a neck pillow and rather take it as a fashion item in form of a lovable doll without showing any image of a neck pillow.

SUMMARY OF THE INVENTION

The present invention is contrived to overcome the conventional disadvantages. Accordingly, an objective of the present invention is to provide a multi-function pillow with an elongate mode defeating a traditional U-shape thus appealing in air travel fashion while providing a variety of different functions so as to satisfy users' changing tastes.

Another objective is to provide a multi-function pillow having a detachably attached blanket to solve an individual confrontation of the inevitable low temperature inside an aircraft, thus enabling a user to maximize comfortability and usability of the product.

A still another objection is to provide a multi-function pillow enabling a user to play the pillow as a travel buddy serving as a playful toy or a lovable doll during a distance air travel.

In order to achieve these and other objectives, the present invention provides: a first and second layer forming an elongate envelope having a side opening being zipped to closure of the envelope, wherein the elongate envelope has a periphery defined by a zip line substantially straight, a seam line substantially parallel to the zip line, and tip lines linking the zip line to the seam line, wherein the zip line is at least four times in length a spread between the zip and seam lines; an inflatable tube detachably attached to and along a first lining of the elongate envelope, wherein an air cap to the tube is formed through the elongate envelope; a tube retainer formed in the elongate envelope to retain the tube within the envelope; a blanket detachably attached to and along a second lining of the envelope, wherein the blanket is either stored and zipped in the envelope or taken out for use by unzipping the envelope; a twine to flex the pillow into a neck cushion, wherein the twine is formed to run in and along the elongate envelope with each end of the twine extending from each end portion of the elongate envelope adjacent to the tip lines; and a pair of twine stops worn on the twine to adjustably keep said each end of the twine outside an outer surface of the pillow.

The twine stops are formed of a plastic material and separable from the twine. The pillow further comprises a first zipper formed along the zip line to open the envelope. The tube retainer comprises a second zipper formed lengthwise to take out the tube therethrough when needed. The blanket is detachably attached to the second lining of the envelope by either snap buttons or hook-and-loop fasteners. The air cap is formed in a push-inflatable button type. The pillow is formed about 50 centimeters in length, wherein the blanket is formed in a dimension of a width of about 1.5 meters and a height of about 1.0 meter. The twine is formed between the tube retainer and the first layer. The twine is formed between the tube retainer and the second layer. The multi-function pillow may further comprise a hidden pocket formed in the first layer adjacent to one of the tip lines, wherein the pocket is zip-closable. The second lining of the envelope is the tube retainer.

BRIEF DESCRIPTION OF THE INVENTION

These and other features, aspects and advantages of the present invention will become better understood with reference to the accompanying drawings, wherein.

DETAILED DESCRIPTION OF THE INVENTION

Figure 1:
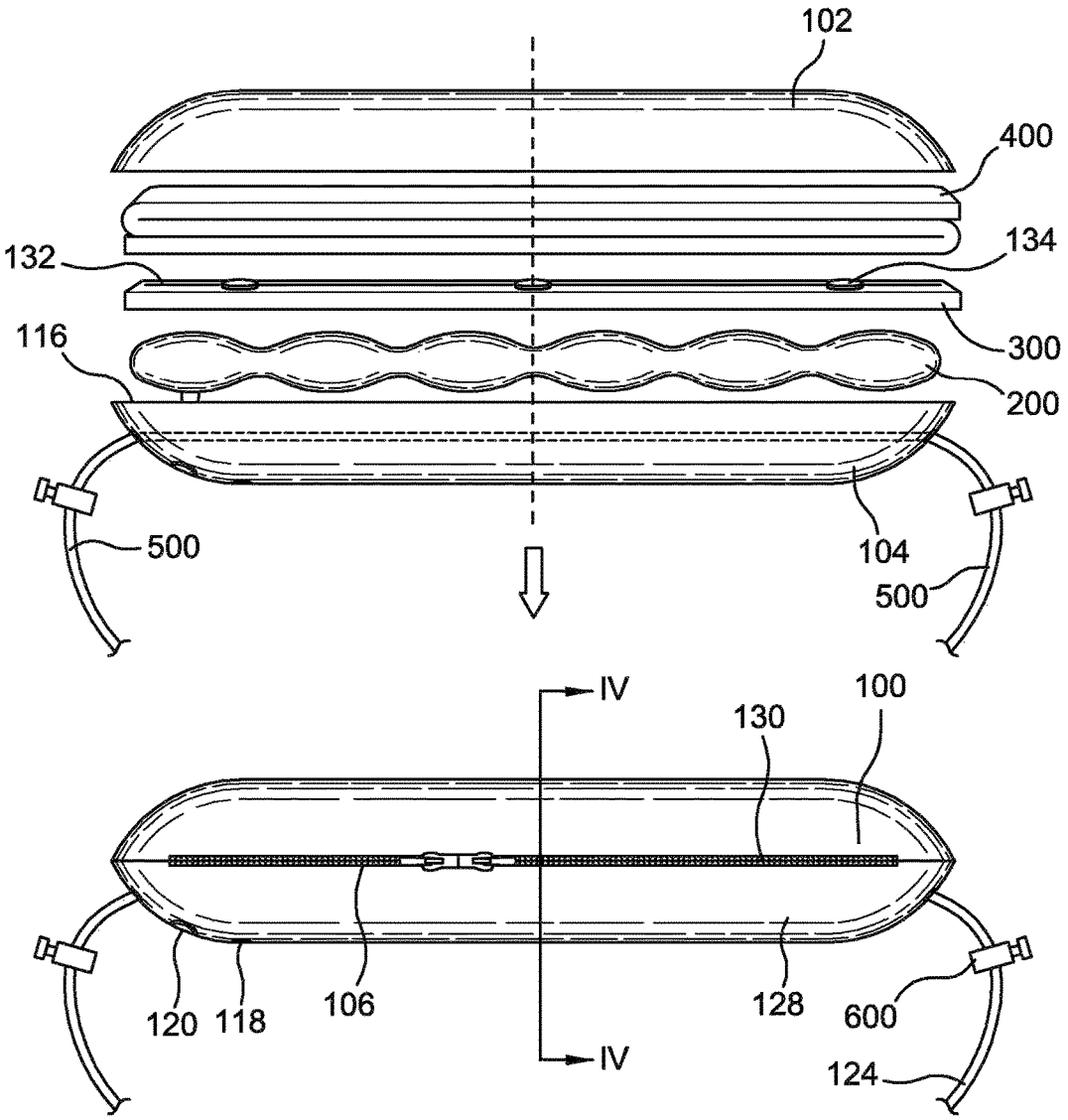
FIG. 1 is a structural view showing mechanism of the multi-function pillow according to the present invention.
Figure 2:
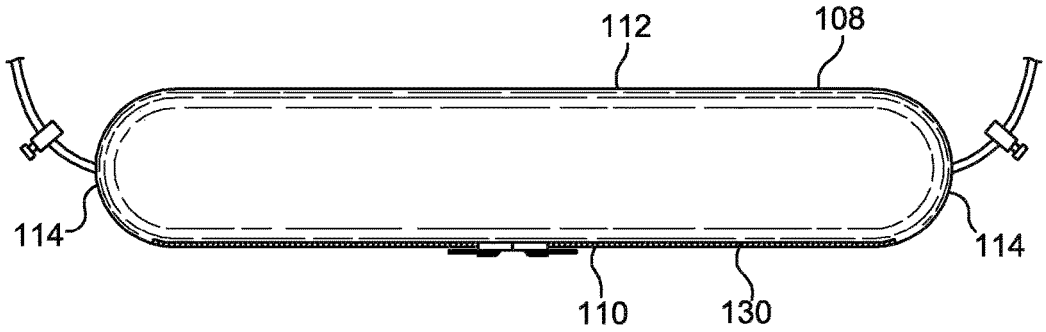
FIG. 2 is a top plan view of the multi-function pillow according to the present invention.
Figure 3:
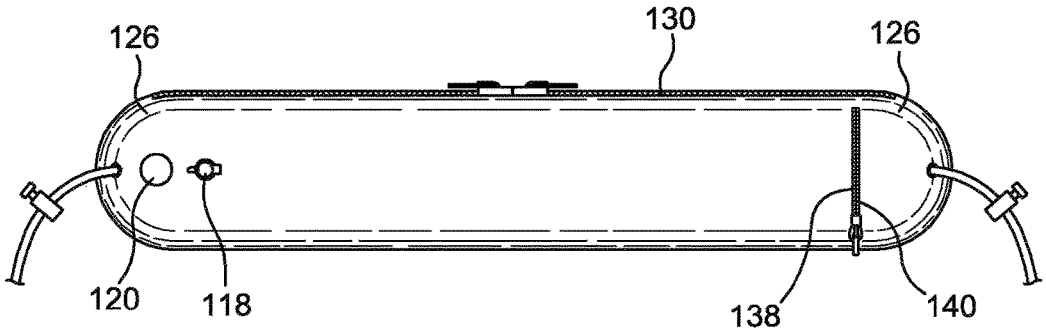
FIG. 3 is a bottom plan view of the multi-function pillow according to the present invention.
Figure 4:
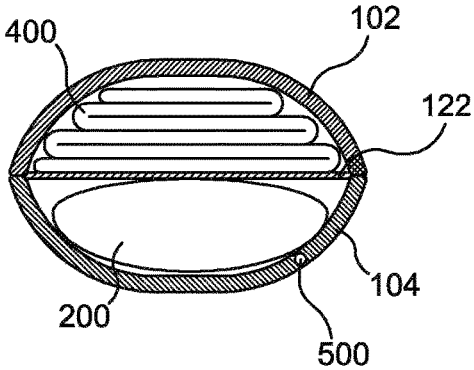
FIG. 4 is a cross-section taken along the line IV-IV in FIG. 1.
Figure 5:
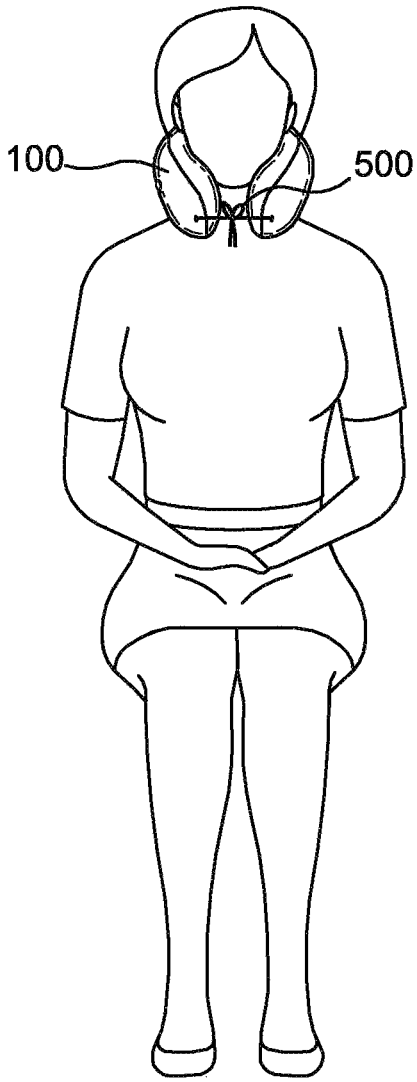
FIG. 5 is a schematic view showing the multi-function pillow worn around a user's neck with the blanket kept in the pillow.
Figure 6:
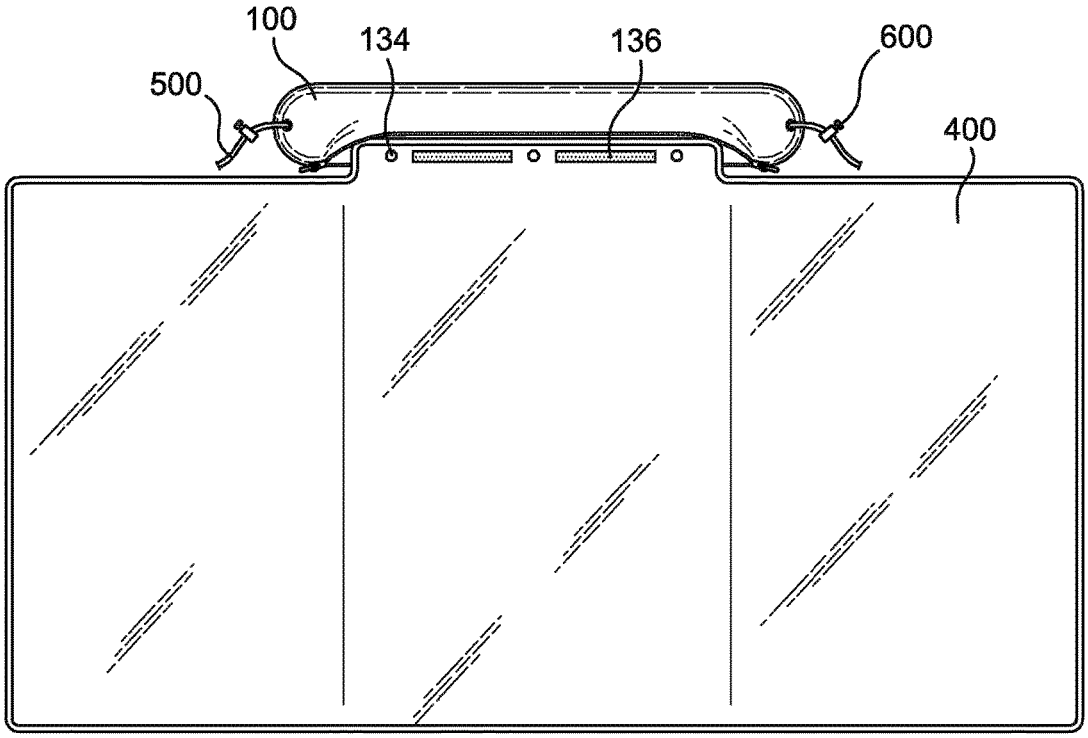
FIG. 6 is a schematic view showing the multi-function pillow with the blanket taken out and spread.
Figure 7:
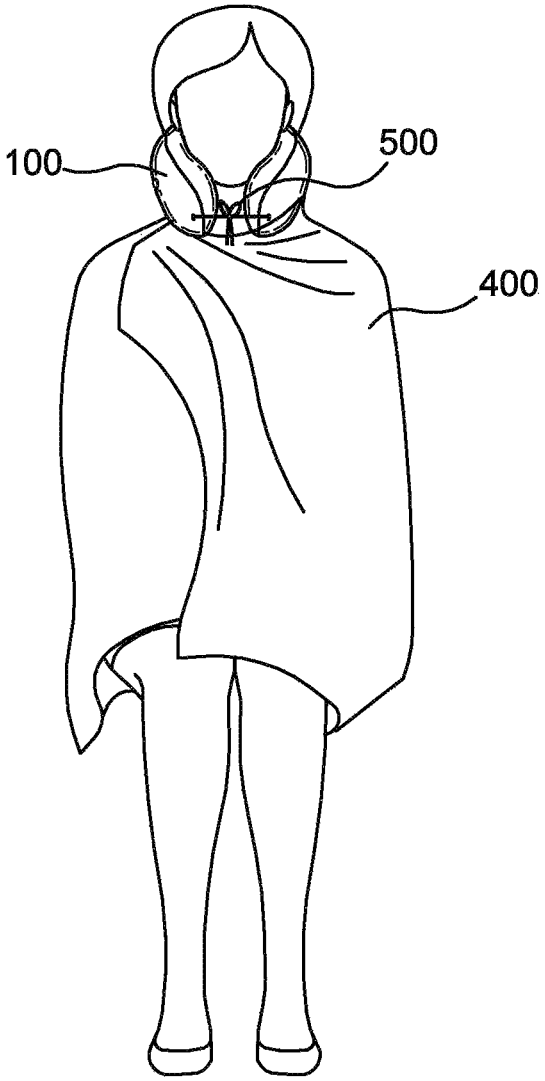
FIG. 7 is a schematic view showing the multi-function pillow with the blanket worn around a user's neck.

A multi-function pillow comprises an envelope 100, an inflatable tube 200, a tube retainer 300, a blanket 400, a twine 500 and twine stops 600. The envelope 100 has a first layer 102 and a second layer 104. The envelope 100 is formed of an elongate shape having a side opening 106 which is zipped to closure of the envelope 100. The elongate envelope 100 has a periphery 108. The periphery 108 is defined by a zip line 110 which is substantially straight, a seam line 112 which is substantially parallel to the zip line 110, and tip lines 114 which are provided to link the zip line 110 to the seam line 112. Preferably, the zip line 110 is at least four times in length a spread between the zip line 110 and the seam line 112. The overall shape of the elongate envelope 100 is close to a French baguette with two elongate parallel lines but the preferable actual shape is substantially flexible since it is made of flexible material like cotton, artificial fabric or flexible plastic.

The inflatable tube 200 further comprised in the multi-functional pillow according to the present invention may be detachably attached to and along a first lining 116 of the elongate envelope 100. In this construction, an air cap 118 to the tube 200 is formed through the elongate envelope 100. The air cap 118 is linked to the inflatable tube 200 so that air can be blown from the air cap 118 into the tube 200. In a preferred version, the air cap 118 can be formed in a button cap so that the tube 200 can be push-inflatable. That is, the tube 200 can be pump inflatable, mouth blow inflatable or push inflatable depending on a user's preference. Alternately, the air cap 118 can be separated from the button cap 120.

The tube retainer 300 is formed in the elongate envelope 100 to retain the tube 200 within the envelope 100. Preferably, the tube 200 is formed of a transparent material like polyethylene terephthalate. The tube retainer 300 is preferably formed of a synthetic fiber selected from rayon, nylon, polyester, acrylic and spandex.

In an embodiment, the blanket 400 is detachably attached to and along a second lining 122 of the envelope 100. Here, the blanket 400 is stored and zipped in the envelope 100, or taken out for use by unzipping the envelope 100. The pillow of the present invention is preferably formed about 50 centimeters in length, and the blanket 400 is formed in a dimension of a width of about 1.5 meters and a height of about 1.0 meter. The blanket 400 may be made of one selected from cotton, wool, fleece, acrylic and polyester.

To improve comfortability and functionality, the pillow further comprises the twine 500 in order to flexibly turn the pillow into a neck cushion. The twine 500 is formed to run in and along the elongate envelope 100 with each end 124 of the twine extending from each end portion 126 of the elongate envelope adjacent to the tip lines 114. The twine 500 may be made of multi-ply synthetic fibers like rayon polyester or nylon.

In a preferred embodiment, the pillow further comprises a pair of twine stops 600 worn on the twine 500 to adjustably keep each end 124 of the twine 500 outside an outer surface 128 of the pillow. Preferably, the twine stops 600 are formed of a plastic material and separable from the twine 500.

Further comprised in the pillow is a first zipper 130 formed along the zip line 110 to open the envelope 100. For a better performance, the tube retainer 300 comprises a second zipper 132 formed lengthwise to take out the tube 200 therethrough when needed.

The blanket 400 is detachably attached to the second lining 122 of the envelope by either snap buttons 134 or hook-and-loop fasteners 136.

The twine 500 is formed between the tube retainer 300 and the first layer 102. Alternately, the twine may be formed between the tube retainer 300 and the second layer 104.

The pillow further comprises a hidden pocket 138 formed in the first layer 102 adjacent to one of the tip lines 114. Preferably, the pocket 138 is zip-closable by a third zipper 140.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A multi-function pillow, comprising:

a first and second layer forming an elongate envelope having a side opening being zippable to closure of the envelope, wherein the elongate envelope has a periphery defined by a zip line substantially straight, a seam line substantially parallel to the zip line, and tip lines linking the zip line to the seam line, wherein the zip line is at least four times in length a spread between the zip and seam lines;

an inflatable tube detachably attached to and along a first lining of the elongate envelope, wherein an air cap to the tube is formed through the elongate envelope;

a tube retainer formed in the elongate envelope to retain the tube within the envelope;

a blanket detachably attached to and along a second lining of the envelope, wherein the blanket is either stored and zipped in the envelope or taken out for use by unzipping the envelope; and a twine to flex the pillow into a neck cushion, wherein the twine is formed to run in and along the elongate envelope with each end of the twine extending from each end portion of the elongate envelope adjacent to the tip lines.

2. The multi-function pillow of claim 1, further comprising a first zipper formed along the zip line to open the envelope.

3. The multi-function pillow of claim 1, wherein the tube retainer comprises a second zipper formed lengthwise to take out the tube therethrough when needed.

4. The multi-function pillow of claim 1, wherein the blanket is detachably attached to the second lining of the envelope by either snap buttons or hook-and-loop fasteners.

5. The multi-function pillow of claim 1, wherein the air cap is formed of a push-inflatable button.

6. The multi-function pillow of claim 1, wherein the pillow is formed about 50 centimeters in length, wherein the blanket is formed in a dimension of a width of about 1.5 meters and a height of about 1.0 meter.

7. The multi-function pillow of claim 1, wherein the twine is formed between the tube retainer and the first layer.

8. The multi-function pillow of claim 1, wherein the twine is formed between the tube retainer and the second layer.

9. The multi-function pillow of claim 1, further comprising a hidden pocket formed in the first layer adjacent to one of the tip lines, wherein the pocket is zip-closable.

10. A multi-function pillow, comprising:

a first and second layer forming an elongate envelope having a side opening being zippable to closure of the envelope, wherein the elongate envelope has a periphery defined by a zip line substantially straight, a seam line substantially parallel to the zip line, and tip lines linking the zip line to the seam line, wherein the zip line is at least four times in length a spread between the zip and seam lines;

an inflatable tube detachably attached to and along a first lining of the elongate envelope, wherein an air cap to the tube is formed through the elongate envelope;

a tube retainer formed in the elongate envelope to retain the tube within the envelope;

a blanket detachably attached to and along a second lining of the envelope, wherein the blanket is either stored and zipped in the envelope or taken out for use by unzipping the envelope;

a twine to flex the pillow into a neck cushion, wherein the twine is formed to run in and along the elongate envelope with each end of the twine extending from each end portion of the elongate envelope adjacent to the tip lines; and a pair of twine stops worn on the twine to adjustably keep said each end of the twine outside an outer surface of the pillow.

11. The multi-function pillow of claim 10, wherein the twine stops are formed of a plastic material and separable from the twine.

12. The multi-function pillow of claim 10, further comprising a first zipper formed along the zip line to open the envelope.

13. The multi-function pillow of claim 10, wherein the tube retainer comprises a second zipper formed lengthwise to take out the tube therethrough when needed.

14. The multi-function pillow of claim 10, wherein the blanket is detachably attached to the second lining of the envelope by either snap buttons or hook-and-loop fasteners.

15. The multi-function pillow of claim 10, wherein the air cap is formed of a push-inflatable button.

16. The multi-function pillow of claim 10, wherein the pillow is formed about 50 centimeters in length, wherein the blanket is formed in a dimension of a width of about 1.5 meters and a height of about 1.0 meter.

17. The multi-function pillow of claim 10, wherein the twine is formed between the tube retainer and the first layer.

18. The multi-function pillow of claim 10, wherein the twine is formed between the tube retainer and the second layer.

19. The multi-function pillow of claim 10, further comprising a hidden pocket formed in the first layer adjacent to one of the tip lines, wherein the pocket is zip-closable.

20. The multi-function pillow of claim 10, wherein the second lining of the envelope is the tube retainer.

* * * * *